US006823902B2

(12) United States Patent
Rudesill et al.

(10) Patent No.: US 6,823,902 B2
(45) Date of Patent: Nov. 30, 2004

(54) TIE WRAP DEBRIS CATCHER

(75) Inventors: Christopher C. Rudesill, Seattle, WA (US); George E. Westbrooke, Kent, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/323,311

(22) Filed: Dec. 18, 2002

(65) Prior Publication Data

US 2004/0118475 A1 Jun. 24, 2004

(51) Int. Cl.[7] ..... B21F 9/02
(52) U.S. Cl. ..... 140/123.6; 83/167
(58) Field of Search ..... 83/167; 140/93 A, 140/93.2, 123.6

(56) References Cited

U.S. PATENT DOCUMENTS 4,357,969 A * 11/1982 Peterpaul ..... 140/123.6

* cited by examiner

*Primary Examiner*—Lowell A. Larson
(74) *Attorney, Agent, or Firm*—Black Lowe & Graham PLLC; Mark S. Beaufait

(57) ABSTRACT

The present invention provides an apparatus for catching tie wrap debris. The apparatus includes a catcher arranged to attach to a tie wrap gun. The catcher is arranged to capture tie wrap tails exiting from the tie wrap gun after tie wraps are tensioned and clipped. The apparatus also includes a collector arranged to attach to the catcher. The collector is arranged to hold captured tie wrap tails. The catcher may be removably attachable to a barrel of the tie wrap gun, and the collector may include a trap arranged to hold tie wrap tails in the collector.

20 Claims, 5 Drawing Sheets

TIE WRAP DEBRIS CATCHER

FIELD OF THE INVENTION

This invention relates generally to wire tie tensioning and, more specifically, to wire tie tensioning and clipping guns.

BACKGROUND OF THE INVENTION

Tie wrap guns or controlled tension installation tools tension and clip wire ties that bundle and attach wires, cables, and other equipment in devices or vehicles such as ships and aircraft.

Tie wrap guns are typically hand-held pistol-shaped devices that are operated manually. The tie wrap guns typically uniformly tension wire ties and clip an extra portion of the wire tie (typically the wire tie tail). In prior art tie wrap guns, wire tie debris such as the clipped tail are typically unrestrained. The unrestrained debris falls away from the gun when the debris or tail is severed from the tie after tensioning. The loose debris or tails must be recovered and removed, which in confined spaces is difficult.

FIG. 1 is a side view of an exemplary prior an tie wrap gun 10. The gun 10 includes a barrel 14 with a tip 12. The tie wrap gun 10 is operated with a trigger 16 that uniformly tensions the tie wrap and clips extra tail material flush from the tie wrap. The tie wrap tail enters the gun and exits from the gun after being severed through an exit 18. It will be appreciated that other exemplary tie wrap guns grasp the tie wrap tail at their tip 12 and have no exit 18 Tie wrap guns 10 are typically pistol-shaped and hand-held. Exemplary tie wrap guns are made by the Panduit Corporation. The tie wrap gun 10 both tensions the tie wrap and severs the extra tail from the tie wrap. It will be appreciated that other tie configurations and other tie wrap guns generate wire tie debris.

Large, power-driven automated tie wrap guns sometimes include integral wire tie debris or tail collectors. However, such automated guns are bulky, heavy, and hard to use in confined or awkwardly shaped spaces. Further, the collectors in automated guns are not removable.

Therefore, an unmet need exists for a lightweight, compact, and simple tie wrap debris catcher, especially for hand-held manual tie wrap guns that may be used in confined spaces.

SUMMARY OF THE INVENTION

The present invention provides a lightweight and flexible apparatus for capturing wire tie debris. The present invention advantageously collects tie wrap debris, thereby reducing time and labor required for cleanup after wire bundling, for example, in aircraft.

An exemplary embodiment of the apparatus includes a catcher arranged to attach to a tie wrap gun. The catcher is arranged to capture tic wrap tails exiting from the tie wrap gun after tie wraps are tensioned and clipped. The apparatus also includes a collector arranged to attach to the catcher. The collector is arranged to hold captured tie wrap tails. In further aspects of the invention, the collector may include a trap arranged to hold tie wrap tails in the collector. In an aspect of the invention, the debris catcher may be easily removable from the tie wrap gun and the debris collector may be readily detached, thereby permitting the collector to be emptied. In extremely confined spaces, the catcher and the collector may be removed from the tie wrap gun, thereby permitting the tie wrap gun to be used alone.

BRIEF DESCRIPTION OF THE DRAWINGS

The preferred and alternative embodiments of the present invention are described in detail below with reference to the following drawings.

DETAILED DESCRIPTION OF THE INVENTION

By way of overview, the present invention provides an apparatus for catching tie wrap debris. The apparatus includes a catcher arranged to attach to a tie wrap gun. The catcher is arranged to capture tie wrap tails exiting from the tie wrap gun after tie wraps are tensioned and clipped. The apparatus also includes a collector arranged to attach to the catcher. The collector is arranged to hold captured tie wrap tails. According to an aspect of the invention, the catcher may be removably attachable to a barrel of a tie wrap gun. In further aspects of the invention, the collector includes a trap arranged to hold tie wrap tails in the collector.

Figure 1:
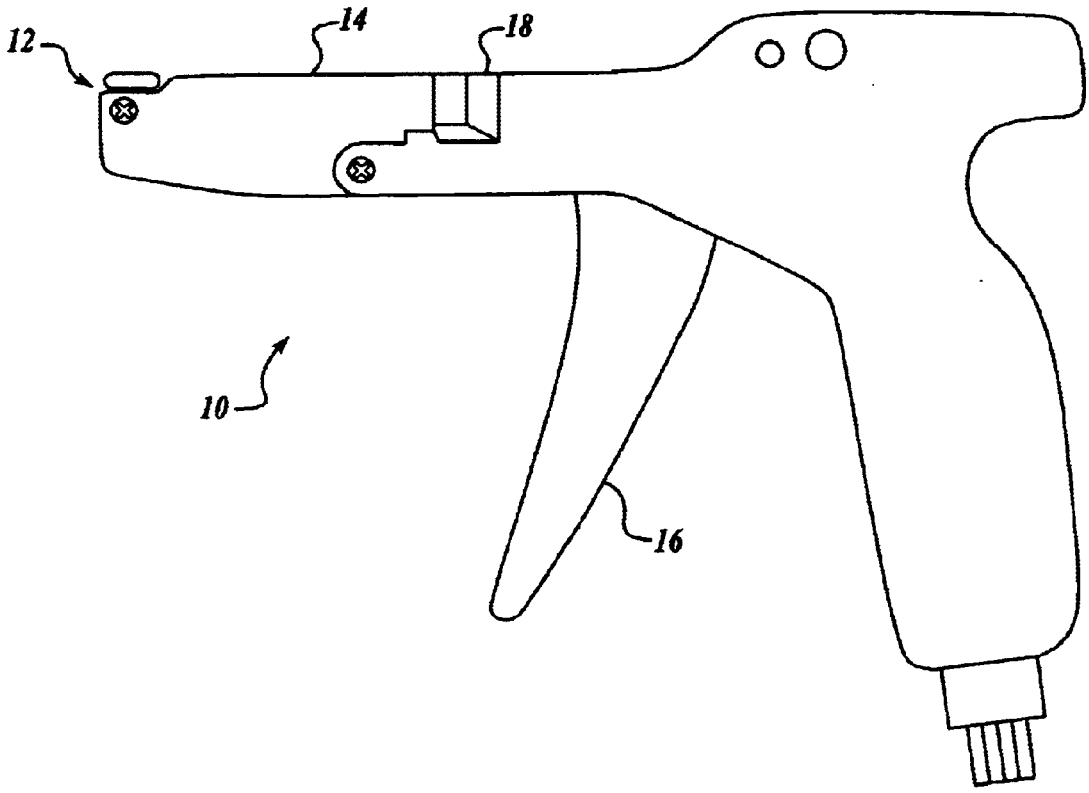
FIG. 1 is a prior art side view of a tie wrap gun.
Figure 2:
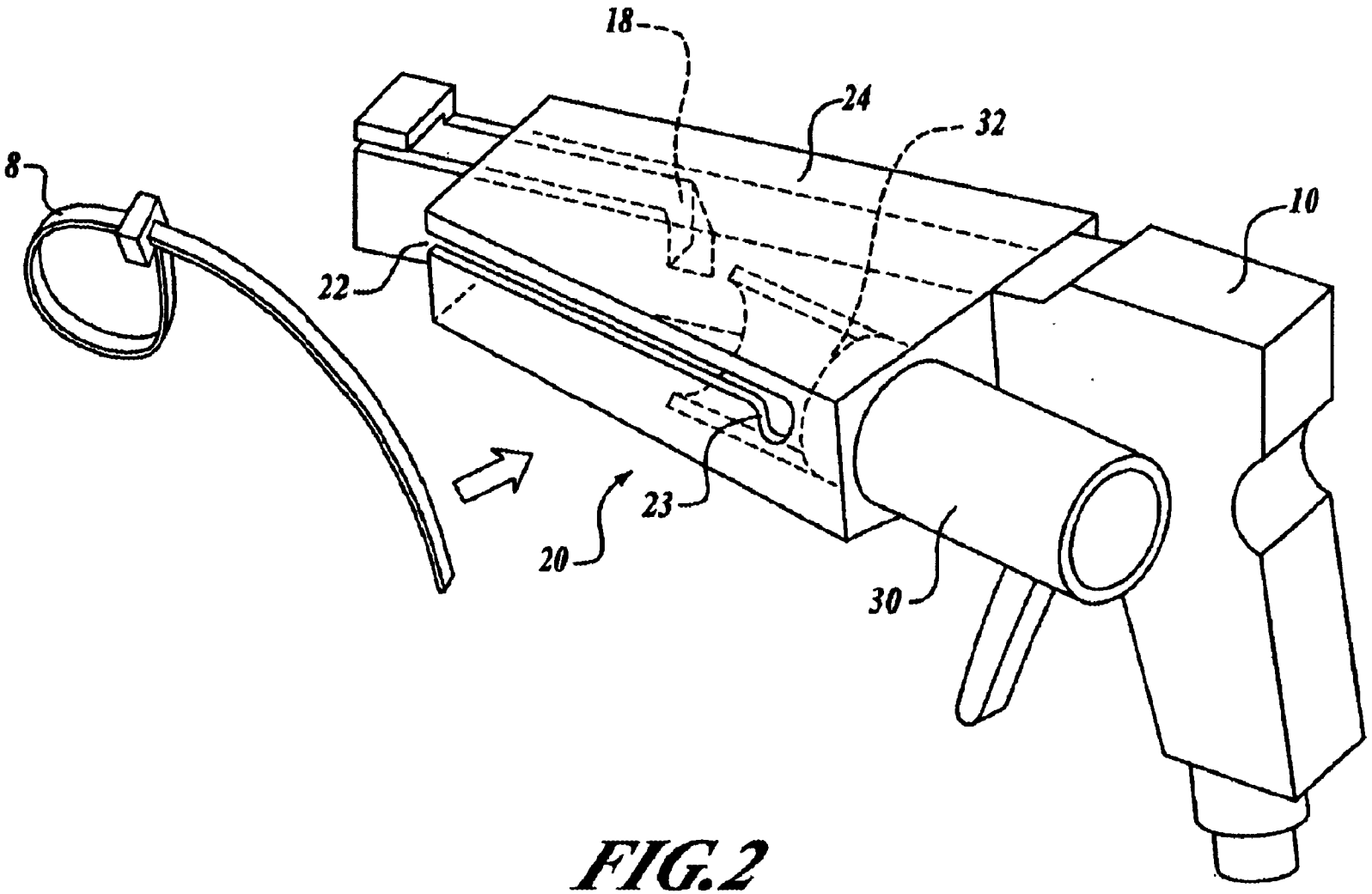
FIG. 2 is an isometric view of a catcher of the present invention attached to a tie wrap gun.

FIG. 2 is an isometric view of an exemplary catcher 20 of the present invention attached to a suitable tie wrap, such as the tie wrap gun 10. Also shown is a wire tie 8 with a tail 9. To operate the tie wrap gun 10, the wire tie 8 is wrapped around a workpiece to be bundled and the tail 9 is inserted into the tip 12 of the gun 10. The trigger 16 of the gun 10 is pulled to tension the wire tie 8 and sever the tail 9. Advantageously, the catcher 20 catches debris such as the clipped portions of the tail 9 that exits from the gun 10 after the tie wrap 8 is tensioned and clipped. It will be appreciated that the catcher 20 suitably captures wire tie debris other than tails 9 produced by other tie configurations, and suitably may be used with other tie wrap guns and tensioning tools.

The catcher 20 is attached to the gun 10 by being slid over the barrel 14. The catcher 20 is suitably held in place by a press fit. In this exemplary embodiment the top 24 and the bottom (not shown) of the catcher 20 suitably press against the barrel 14 to hold the catcher 20 on the gun 10. This permits the catcher 20 to be readily removed by the tie wrap operator if a confined space permits only the barrel 14 of the gun 10 to be inserted into the confined space to tension the wire tie 8.

The catcher 20 has a slot 22 which facilities entry of the wire tie tail 9 into the catcher 20 and the gun 10. The slot 22 is suitably located on the loading side 25 of the catcher 20. The slot 22 is configured to allow the tie wrap tail 9 to easily enter the catcher 20 and be grasped by the tip 12 of the gun 10. The catcher 20 covers an exit 18 of the gun 10 where the severed tie wrap tail 9 exits the gun after being tensioned and severed. It will be appreciated that for a tie wrap gun 10 without a specific exit 18 the catcher 20 is suitably arranged to cover the barrel 14 and tie wrap tail 9 when the tie wrap tail 9 is grasped and then clipped at the tip 12 of the gun 10.

In one exemplary embodiment of the present invention, the catcher 20 is a trapezoidal-shaped box that fits over the barrel 14 of the gun 10. A tube 30 is mounted inside the catcher 20 and extends outside of the catcher 20 to mate with a collector (not shown). The tube 30 is shaped with a cutaway portion 32 inside the catcher to catch the severed end of the tie wrap tail 9 and guide it into the tube 30. The cutaway portion 32 is suitably cutaway on the side of the tube 30 facing the slot 22 leaving an opening thereby assisting the operator in threading the tie 9 into the gun 10. This permits the tail, when severed, to fall into the tube 30 within the catcher 20. The tube 30 then communicates the severed tail 9 into a collector (not shown).

The slot 22 on the loading side 25 of the catcher 20 has an open end 21 near the tip 12 of the gun 10, and a closed guide end 23 near the tube 30. The guide end 23 helps guide the tie wrap tail 9 into the gun 10. The guide end 23 in the exemplary embodiment shown in FIG. 2 is a rounded end having a width wider than that of the slot 22. The rounded guide end 23 aids in sliding the wire tail 9 (shown in solid lines) into the catcher 20 and the gun 10 before the gun 10 is operated. In this exemplary embodiment, the tube 30 inside the catcher 20 extends near the exit 18 of the gun 10 toward a location where the severed tie 9 is released by the gun 10 after gun operation. This aids in guiding the severed tie wrap tail 9 into the tube 30 for communication with the collector (not shown).

Figure 3:
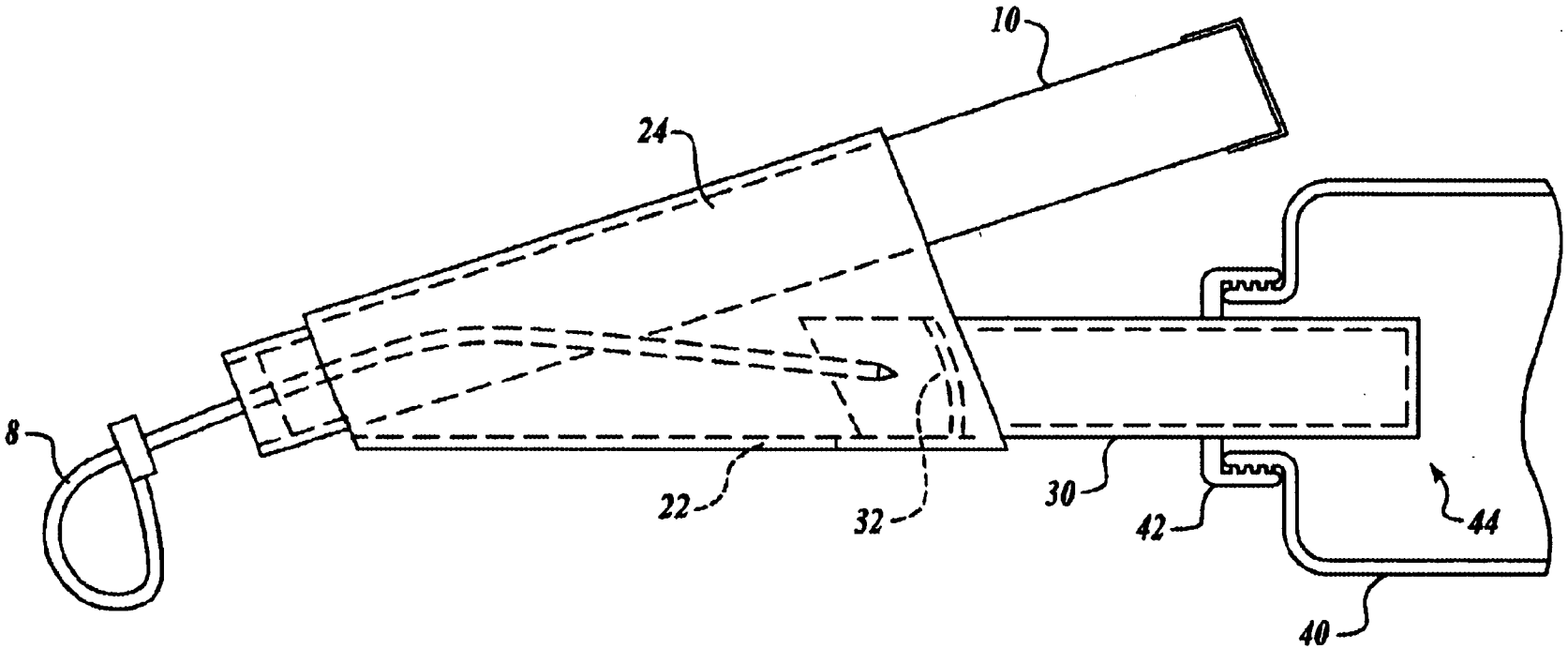
FIG. 3 is a top view of a catcher and a collector of the present invention attached to a tie wrap gun.

FIG. 3 is a top view of the exemplary embodiment of the present invention illustrated in FIG. 2. The catcher 20 is attached to the gun 10. The wire tie 8 is shown inserted into the tip 12 of the gun 10 with the tail of the tie wrap 9 held within the catcher 20. The wire tie tail 9 is shown inside the catcher 20, having been slid into the catcher 20 and the gun 10 through the slot 22 (shown in cross-section). The tip of the wire tie tail 9 extends into the cutaway portion 32 of the tube 30 that guides the severed tie wrap tail into a collector 35.

As noted, in this exemplary embodiment the catcher 20, as viewed from above, has a trapezoidal top 24 holding the tube 30 at a suitable angle to the side of the gun 10. In this embodiment, the catcher 20 holds the tube 30 at an angle of approximately 20 degrees to the barrel 14 of the gun 10. It will be appreciated that any suitable angle between the gun 10 and the collector 35 that permits the tip of the gun to be held in the desired position for tensioning and wire tie 8 may be utilized. In the embodiment shown in FIG. 3, the collector 35 is suitably a container such as without limitation a bottle 40. Any suitable bottle or container may be utilized. By way of example, but not limitation, a 20-ounce clear plastic empty soda bottle has been found to serve as a suitable collector 35. In this embodiment, the bottle 40 has a cap 42 with a cap opening 41 that fits over the tube 30. The cap opening 41 is sized to permit the collector 35 to be removably detachable from the catcher 20. In this embodiment, the attachment between the bottle 40 and the tube 30 is a press fit. It will be appreciated that any suitable connection, permanent or removable, may be utilized to connect the collector 35 to the catcher 20. By way of example, the collector 35 could be screwed onto or into the catcher 20 with or without an intervening tube 30. In FIG. 3, the tube 30 advantageously extends into the bottle 40 via an extension portion 45 forming a trap 44. Tie wrap tails 9 that fall into the collector 35 and bottle 40 tend to be trapped once they enter the bottle by the extension portion 45 that forms the trap 44. It will be appreciated that the trap 44 assists in preventing the wire tie debris from falling out of the collector 35. However, it will further be appreciated that the catcher 20 itself is suitably enclosed to hold the wire tie debris. Therefore the trap 44 is not necessary in all applications. It will also be appreciated that any suitable trap, such as by way of non-limiting example a pivoting flap, may be utilized to trap wire tie debris such as wire tie tails 9 in the collector 35.

Figure 4A:
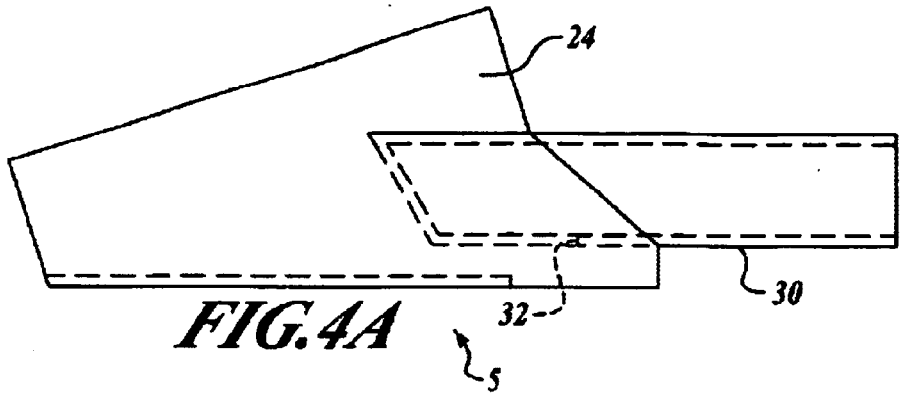
FIG. 4A is a top view of an exemplary catcher of the present invention.

FIG. 4A shows the top 24 of the catcher 20 with the tube 30 extending from the catcher 20. The cutaway portion 32 of the tube 30 where the tube 30 extends into the catcher 20 is shown in dashed cross-section. The cutaway portion 32 suitably forms the end of the tube 30 within the catcher 20. The cutaway portion 32 is suitably configured to nest near the exit 18 (not shown) of the tie wrap gun 10 (not shown). In the example shown in FIG. 4A, the cutaway portion 32 leaves the side of the tube 30 within the catcher 20 nearest the entry slot 22 shorter than the side of the tube 30 within the catcher 20 closest to the gun 10 (not shown). It will be appreciated that any suitable shape for the cutaway portion 32 or other termination of the tube 30 within the catcher 20 may be utilized to assist in catching wire tie debris and guiding the debris into the tube 30 for communication to the collector 35 (not shown).

Figure 4B:
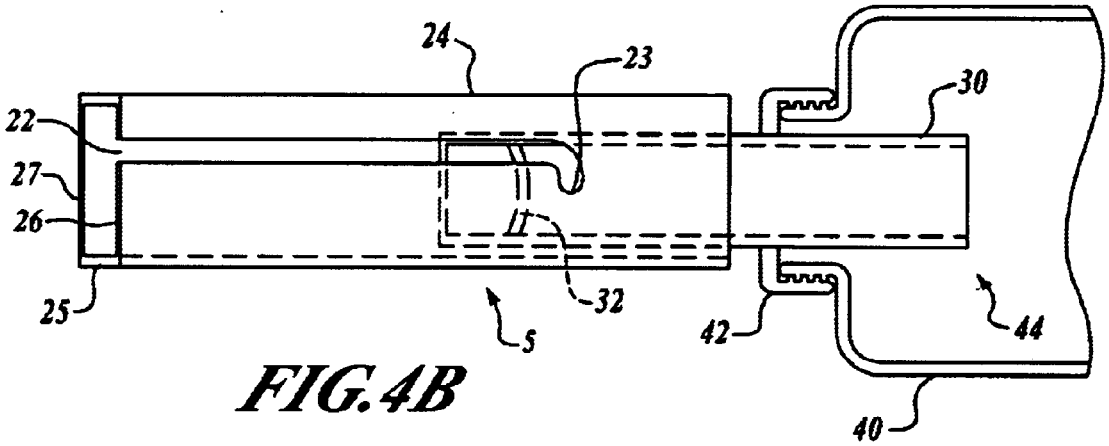
FIG. 4B is a side view of an exemplary catcher of the present invention with an attached collector bottle.

FIG. 4B is a detailed loading side view of an exemplary embodiment of the present invention. In this embodiment, the catcher 20 is suitably box-shaped with a top 24, a loading side 25, a bottom 28, and a back side 27. As shown in FIG. 4B, the collector 35 is suitably a bottle 40 with a cap 42 that is slid over the tube 30. In this exemplary embodiment, the extension portion 45 the tube 30 into the bottle 40 forms a trap 44. The view from FIG. 4B is from the loading slot side of the present invention. The loading side slot of the catcher 20 has a slot 22 allowing entry of the wire tie tail (not shown) into the catcher 20 and into the tie wrap gun (not shown). In the embodiment shown in FIG. 4B, the slot 22 is open at a tip end 29 that is nearest the tip of the tie gun (not shown). The tip of the tie wrap gun (not shown) extends through the tip end 29 of the catcher 20. The slot 22 in the loading side 25 of the catcher 20 allows the tie wrap tail (not shown) to be threaded into the catcher 20 and into the tie wrap gun (not shown). The end of the slot 22 nearest the collector 35 has a guide end 23. In FIG. 4B, the guide end 23 suitably defines a rounded opening with a width wider than that of the slot 22. In this exemplary embodiment, the guide end 23 defines a rounded, bulbous opening that droops downward.

Figure 4C:
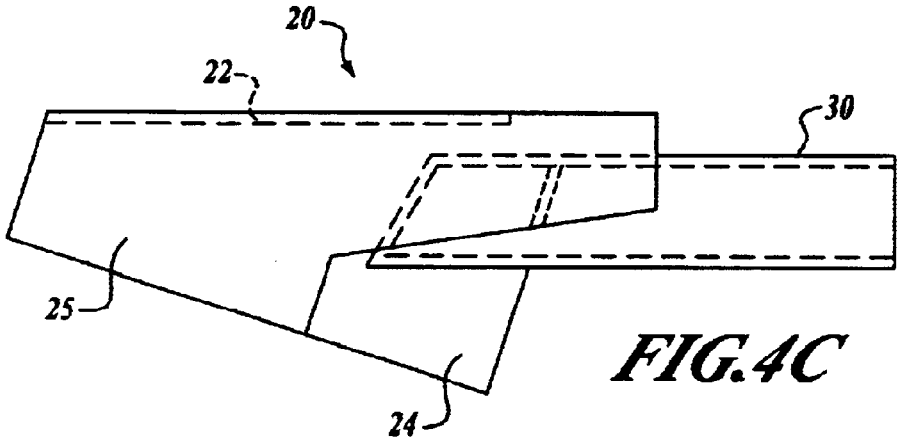
FIG. 4C is a bottom view of an exemplary catcher of the present invention.
Figure 4D:
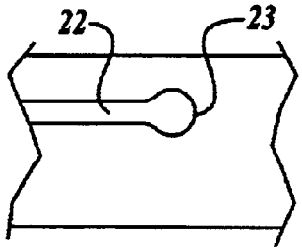
FIG. 4D is side-view detail of an exemplary alternate guide end for a catcher of the present invention.

FIG. 4D is a detailed drawing showing an alternately shaped guide end 23. In FIG. 4D, the guide end is a symmetrical rounded bulb forming the closed end of the slot 22 and is centered on the slot 22. It will be appreciated that any suitable shape to the guide end 23 that assists in threading the tie wrap into the catcher 20 and into the tie wrap gun may be utilized, including any suitable rounded and/or bevel-shaped opening. It will also be appreciated that with wire ties that are suitably flexible or short, no special guide end 23 is required for the slot 22. It will also be appreciated that any suitable slot length and width that will facilitate loading of the tie wrap gun (not shown) may be utilized in connection with the present invention.

FIG. 4C is a bottom view of the catcher 20 of the present invention shown in FIGS. 4A and 4B. The catcher 20 has a bottom 28 with a tip end 29. Extending from the other end of the bottom 28 is the tube 30 with the cutaway portion 32.

The slot 22 for entry of the tie wrap tail is shown in phantom. It will be appreciated that the slot shown in this embodiment may suitably be substituted with a guide of any suitable shape to permit entry of a wire tie. While a slot 22 is utilized in this embodiment, by way of example and not limitation, suitable guide openings can include overlapping flaps, opposing brushes, or conical or wedge-shaped funnels configured to assist in guiding the tie (not shown) into the catcher 20 or the like. The bottom 28 is suitably shaped with a trigger area 31 that allows space for the trigger (not shown) of the tie wrap gun (not shown) to be operated when the catcher 20 is installed on the gun. In this embodiment, the top 24 of the catcher 20 suitably extends over the barrel of the gun (not shown). The bottom 28 and the top 24 suitably hold the catcher 20 securely on the gun (not shown) while still allowing the trigger (not shown) to be operated.

Figure 5A:
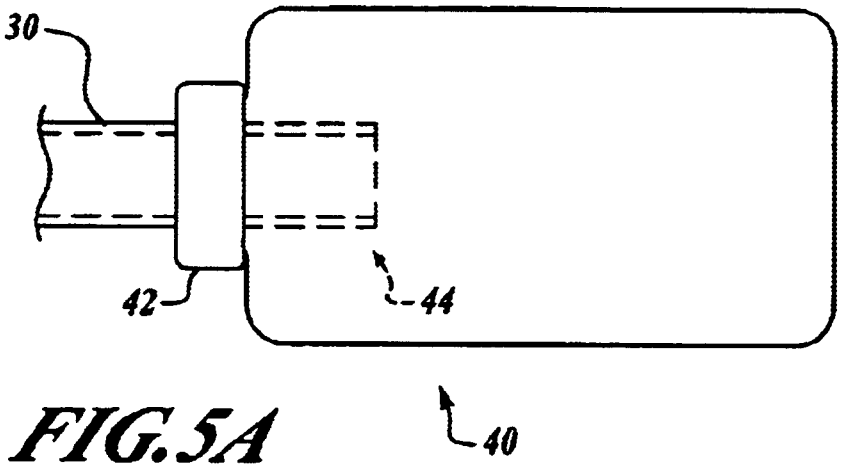
FIG. 5A is a side view of an exemplary collector bottle of the present invention.

FIG. 5A shows an exemplary collector 35 of the present invention. FIG. 5A is a side view of the bottle 40 forming the collector 35. In the exemplary embodiment shown in FIGS. 3 and 4B, the collector 35 is a plastic soda bottle as shown in FIG. 5A. It will be appreciated that any suitable bottle or container may be utilized to collect wire ties or debris (not shown). In this exemplary embodiment the cap 42 slides over the tube 30. The tube 30 extends into the bottle 40 forming the trap 44 as described above. To empty the bottle 40, the bottle may be slid off the tube 30, or the bottle 40 may be unscrewed from its cap 42, allowing wire tie wrap debris to be discarded.

Figure 5B:
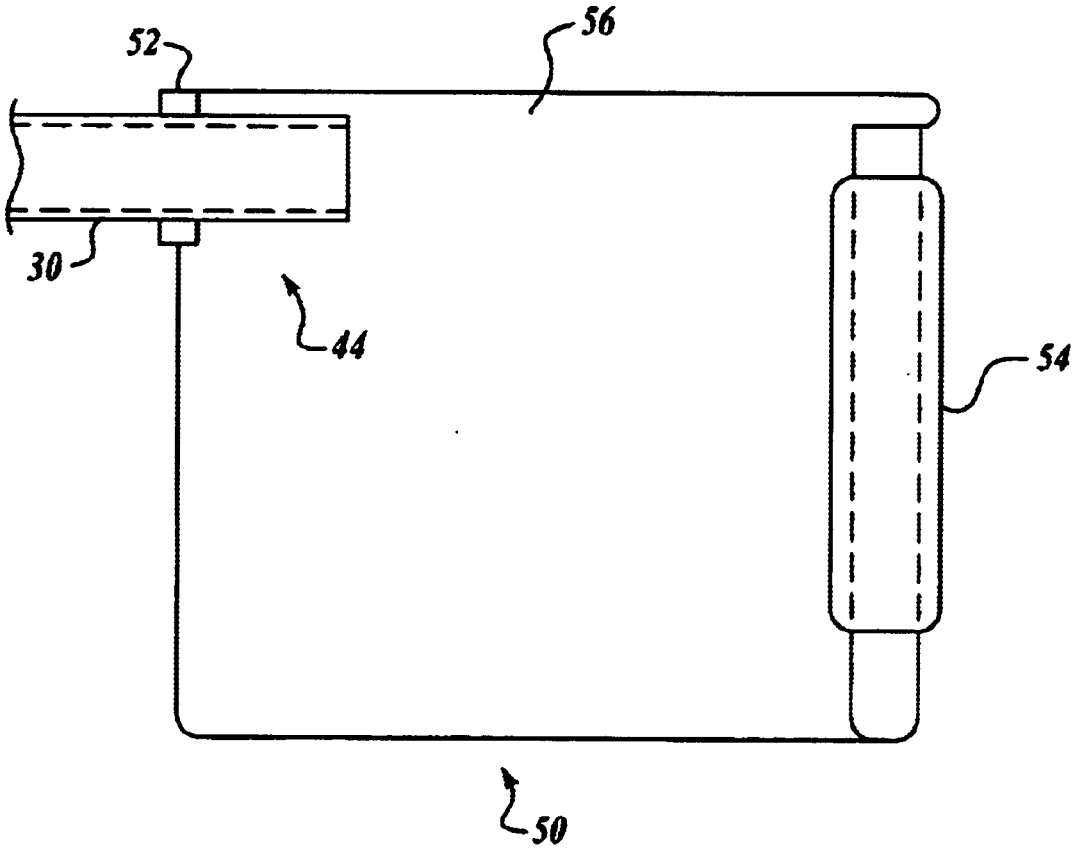
FIG. 5B is a side view of an exemplary collector bag of the present invention.

FIG. 5B shows an alternate exemplary embodiment of a collector 135 of the present invention. In this embodiment, the collector 135 includes a bag 50. The bag 50 has a clamp 52 that slides over in a press fit onto the tube 30 of the catcher (not shown). In this embodiment, the tube 30 extends into the bag 50 forming a trap 44 as described above. In one embodiment, the bag 50 is suitably made of fabric. It will be appreciated that any suitable material including plastic, vinyl, nylon, or cotton may suitably be used for the bag 50. In this embodiment, the bag 50 has a clamp 54 that holds a normally open end of the bag 50 closed, yet allows the bag 50 to be opened for emptying wire tic debris. It will be appreciated that the collector 135 may be other than the bag 50 as in FIG. 5B or the bottle 40 (FIG. 5A) and that any suitably shaped collector may be utilized.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. An apparatus for catching tie wrap tails, the apparatus comprising:

a catcher arranged to attach to a barrel of a tie wrap gun, the catcher being further arranged to capture tie wrap tails exiting from the tie wrap gun after tie wraps are tensioned and clipped, and a collector attached to the catcher, the collector being arranged to hold captured tie wrap tails.

2. The apparatus of claim 1, wherein the catcher is removably attachable to the tie wrap gun.

3.The apparatus of claim 2, wherein the catcher is arranged to removably attach onto the tie wrap gun with a press fit.

4. The apparatus of claim 1, wherein the collector includes a trap arranged to trap tie wrap tails in the collector.

5. The apparatus of claim 4, wherein the trap includes a tube extending into the collector.

6. The apparatus of claim 1, wherein the collector is removably attachable to the catcher.

7. The apparatus of claim 6, wherein the collector is arranged to press fit onto the catcher.

8. The apparatus of claim 1, wherein the collector includes a bag.

9. The apparatus of claim 1, wherein the catcher includes a tube having a first end arranged to capture tie wrap tails, the tube having a second end arranged to direct tails to the collector.

10. An apparatus for catching tie wrap tails, the apparatus comprising:

a catcher arranged to attach to a barrel of a tie wrap gun, the catcher being further arranged to capture tie wrap tails exiting from the tie wrap gun after tie wraps are tensioned and clipped, wherein the catcher further defines a guide arranged to guide a tie wrap into position for tensioning by the tie wrap gun, and a collector attached to the catcher, the collector being arranged to hold captured tie wrap tails.

11. The apparatus of claim 10, wherein the guide defines a slot having a width, the slot extending through a portion of the catcher.

12. The apparatus of claim 11, wherein the slot further defines a guide end, the guide end defining an opening wider than the width of the slot, the guide end being arranged to aid the guiding of a tail of a tie wrap into the tie wrap gun.

13. An apparatus for catching tie wrap tails, the apparatus comprising:

a catcher arranged to attach to a barrel of a tie wrap gun, the catcher being further arranged to capture tie wrap tails exiting from the tie wrap gun after tie wraps are tensioned and clipped; wherein the collector includes a blown plastic bottle; and a collector attached to the catcher, the collector being arranged to hold captured tie wrap tails.

14. An apparatus for catching debris that have been severed from a tie wrap by a tie wrap gun, the apparatus:

a catcher arranged to attach to a barrel of a tie wrap gun, the catcher defining a guide arranged to guide a tie wrap into position for tensioning by the tie wrap gun, the catcher including a trap arranged to trap debris that has been severed from the tie wrap by the tie wrap gun; and a collector attached to the trap, the collector being arranged to hold debris communicated by the trap.

15. The apparatus of claim 14, wherein the collector includes a bottle.

16. The apparatus of claim 14, wherein the trap includes a tube extending into the collector.

17. The apparatus of claim 14, wherein the catcher is removably attachable to the tie wrap gun.

18. The apparatus of claim 14, wherein the collector is removably attached to the catcher.

19. A method for collecting tie wrap debris, the method comprising:

attaching a catcher to a barrel of a tie wrap gun, the catcher being arranged to catch wire tie debris severed from a tie wrap by the tie wrap gun, the catcher being further arranged to communicate the debris to a collector;

attaching a collector to the catcher, the collector being arranged to collect debris communicated by the catcher;

cutting a tie wrap thereby severing debris from the tie wrap;

catching the debris in the catcher;

communicating the debris from the catcher to the collector; and collecting the debris in the collector.

20. The method of claim 19, further comprising trapping the debris in the collector.

* * * * *